United States Patent [19]

Bernardino et al.

[11] Patent Number: 4,681,704

[45] Date of Patent: Jul. 21, 1987

[54] DETERGENT COMPOSITION CONTAINING SEMI-POLAR NONIONIC DETERGENT ALKALINE EARTH METAL ANIONIC DETERGENT AND AMINO ALKYLBETAINE DETERGENT

[75] Inventors: Lowell W. Bernardino; Edward W. Kuhl; Mark H. K. Mao; Eugene J. Pancheri, all of Cincinnati, Ohio

[73] Assignee: The Procter & Gamble Company, Cincinnati, Ohio

[21] Appl. No.: 904,828

[22] Filed: Sep. 8, 1986

Related U.S. Application Data

[63] Continuation of Ser. No. 761,661, Jul. 31, 1985, abandoned, which is a continuation of Ser. No. 591,097, Mar. 19, 1984, abandoned.

[51] Int. Cl.[4] ..... C11D 1/29; C11D 1/75; C11D 1/90; C11D 1/94

[52] U.S. Cl. ..... 252/546; 252/133; 252/153; 252/173; 252/541; 252/547; 252/550; 252/551; 252/553; 252/558; 252/DIG. 5; 252/DIG. 14

[58] Field of Search ..... 252/133, 153, 546, 547, 252/550, 551, DIG. 13

[56] References Cited

U.S. PATENT DOCUMENTS

| | | | |
|---|---|---|---|
| 3,533,955 | 10/1970 | Pader | 252/153 |
| 3,849,348 | 11/1974 | Hewitt | 252/547 |
| 3,950,417 | 4/1976 | Verdicchio et al. | 252/545 |
| 4,133,779 | 1/1979 | Hellyer et al. | 252/54 |
| 4,137,191 | 1/1979 | Lohr | 252/153 |
| 4,166,048 | 8/1979 | Nishimura et al. | 252/546 |
| 4,375,421 | 3/1983 | Rubin et al. | 252/110 |

FOREIGN PATENT DOCUMENTS

| | | |
|---|---|---|
| 7028905 | 5/1966 | Japan . |
| 50076106 | 9/1973 | Japan . |
| 1128836 | 10/1968 | United Kingdom . |
| 1306969 | 2/1973 | United Kingdom . |
| 1452708 | 10/1976 | United Kingdom . |
| 2103236 | 2/1983 | United Kingdom . |

OTHER PUBLICATIONS

McCutcheon's Detergents & Emulsifiers-1978 N. American Ed., MC Publishing Co., Glen Rock, N.J. 07452, pp. 79 and 174.

*Primary Examiner*—Dennis L. Albrecht
*Attorney, Agent, or Firm*—Robert B. Aylor; Richard C. Witte; Thomas H. O'Flaherty

[57] ABSTRACT

A detergent composition containing a semi-polar nonionic detergent, an alkaline earth metal salt of an anionic detergent, and an amidoalkylbetaine. The composition is especially useful for the removal of greasy soils and has good suds mileage.

17 Claims, No Drawings

DETERGENT COMPOSITION CONTAINING SEMI-POLAR NONIONIC DETERGENT ALKALINE EARTH METAL ANIONIC DETERGENT AND AMINO ALKYLBETAINE DETERGENT

This is a continuation of application Ser. No. 761,661, filed on July 31, 1985, now abandoned, which is a continuation of application Ser. No. 591,097 filed on Mar. 19, 1984, now abandoned.

BACKGROUND OF THE INVENTION

This invention relates to a detergent composition especially formulated for the removal of greasy soils. More particularly, it relates to a detergent composition containing a semi-polar nonionic detergent, an alkaline earth metal, preferably magnesium salt of an anionic detergent and an amidoalkylbetaine.

Detergent compositions containing a wide variety of water-soluble organic detergents or mixtures thereof have been formulated. Recognizably, certain water-soluble organic detergents are better at removing one type of soil than other detergents. For example, anionic detergents are noted for their ability to remove carbohydrate and protein type stains, while nonionic detergents are especially useful in the removal of grease and oil stains. Various mixtures of detergents have been tried in order to find the optimum combination for removing a wide variety of stains as is normally encountered on soiled articles. (See for example, U.S. Pat. Nos. 2,691,636, 3,085,982, 3,179,599, 3,196,166 and 3,223,647 for various organic detergent combinations.) However, there is a continuing need for detergent compositions that are effective in removing soils, especially greasy soils.

Additionally, various salts such as magnesium and calcium chloride and magnesium sulfate have been suggested as detergent composition additives for improving their detergency (see U.S. Pat. Nos. 2,908,651; 2,437;253 and; 4,133,779). All of the patents listed herein are incorporated herein by reference.

It has now been found that a detergent composition especially effective in the removal of greasy soil is formulated using a semi-polar nonionic detergent, an alkaline earth metal salt of certain anionic detergents, and an amidoalkylbetaine.

As used herein, all percentages, parts and ratios are by weight unless otherwise indicated.

SUMMARY OF THE INVENTION

A detergent composition especially effective in removing greasy soils wherein the organic detergent portion of said composition consists essentially of a mixture of:

(a) from about ½% to about 10%, preferably from about 1% to about 8%, of a semi-polar organic nonionic detergent selected from the group consisting of (1) water-soluble amine oxides having one alkyl or hydroxyalkyl moiety of 8 to 28 carbon atoms and two alkyl moieties selected from the group consisting of alkyl groups and hydroxyalkyl groups of 1 to 3 carbon atoms, (2) water-soluble phosphine oxides having one alkyl or hydroxyalkyl moiety of 8 to 28 carbon atoms and two alkyl moieties selected from the group consisting of alkyl groups and hydroxyalkyl groups of 1 to 3 carbon atoms, (3) water-soluble sulfoxides having one alkyl or hydroxyalkyl moiety of 8 to 18 carbon atoms and an alkyl moiety selected from the group consisting of alkyl and hydroxyalkyl groups of 1 to 3 carbon atoms, and (4) mixtures thereof;

(b) from about 10% to about 50%, preferably from about 15% to about 40%, of an alkaline earth metal, preferably magnesium, salt of an anionic detergent selected from the group consisting of (1) linear alkyl benzene sulfonates having 9 to 15 carbon atoms in the alkyl group, (2) alkyl sulfates having 8 to 22 carbon atoms, (3) paraffin sulfonates having 8 to 22 carbon atoms, (4) olefin sulfonates having 8 to 22 carbon atoms, (5) alkyl ether sulfates having 8 to 22 carbon atoms in the alkyl group and 1 to 30 ethylene oxide units (6) alkyl glyceryl ether sulfonates having 8 to 22 carbon atoms in the alkyl group and (7) mixtures thereof; and (c) from about ½% to about 15%, preferably from about 1% to about 10% of an acylamidoalkylbetaine of the formula:

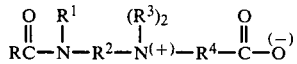

wherein R is an alkyl group, or alkylaryl group containing from about 7 to about 21 carbon atoms, preferably from about 9 to about 17 carbon atoms; $R^1$ is hydrogen or an alkyl group containing from 1 to about 6 carbon atoms, preferably from 1 to about 3 carbon atoms; $R^2$ is an alkylene group containing from 1 to about 10 carbon atoms, preferably from about 2 to about 6 carbon atoms, most preferably 3 carbon atoms; each $R^3$ is an alkyl or hydroxy alkyl group containing from 1 to about 6 carbon atoms, preferably from 1 to about 3 carbon atoms, most preferably 1 carbon atom or an ethoxylated hydroxy alkyl containing from about 1 to about 10 ethylene oxide units; and $R^4$ is an alkylene group containing from 1 to about 6 carbon atoms, preferably one carbon atom.

DETAILED DESCRIPTION OF THE INVENTION

The detergent compositions of this invention contain a water-soluble semi-polar nonionic detergent, an alkaline earth metal salt of an anionic detergent, and an amidoalkylbetaine as essential ingredients. Descriptions of these detergents follow.

Semi-polar nonionic detergents useful herein include water-soluble amine oxides, phosphine oxides and sulfoxides. Amine oxides are preferred. The amine oxide has one alkyl or hydroxyalkyl moiety of 8 to 26 carbon atoms, preferably 8 to 16 carbon atoms and two alkyl moieties selected from the group consisting of alkyl groups and hydroxyalkyl groups containing 1 to 3 carbon atoms. Examples of such materials include dimethyloctylamine oxide, diethyldecylamine oxide, bis-(2-hydroxyethyl)dodecylamine oxide, dimethyldodecylamine oxide, dipropyltetradecylamine oxide, methylethylhexadecylamine oxide, and dimethyl-2-hydroxyoctadecylamine oxide.

Suitable semi-polar nonionic detergents also include the water-soluble phosphine oxides having one alkyl or hydroxyalkyl moiety of 8 to 28 carbon atoms, preferably 8 to 16 carbon atoms and two alkyl moieties selected from the group consisting of alkyl groups and hydroxyalkyl groups containing 1 to 3 carbon atoms. Examples of suitable phosphine oxides include dimethyldecylphosphine oxide, dimethyltetradecylphosphine oxide, methylethyltetradecylphosphine oxide, dimethylhexadecylphosphine oxide, diethyl-2-hydroxyoctyldecylphosphine oxide, bis(2-hydroxyethyl)dodecylphosphine oxide, and bis(hydroxymethyl)tetradecylphosphine oxide.

The water-soluble sulfoxide detergents contain one alkyl or hydroxyalkyl moiety of 8 to 18 carbon atoms, preferably 12 to 16 carbon atoms and one alkyl moiety selected from the group consisting of alkyl and hydroxyalkyl groups having 1 to 3 carbon atoms. Specific examples of these sulfoxides include dodecylmethyl sulfoxide, 2-hydroxyethyltridecyl sulfoxide, hexadecylmethyl sulfoxide, 3-hydroxyoctadecylethyl sulfoxide.

The anionic detergent comprises at least about 10%, preferably at least about 15% of an alkaline earth metal, preferably magnesium, salt of an organic anionic detergent. The remainder are typically sodium, potassium, ammonium and/or substituted ammonium salts. Especially preferred salts are the magnesium salts. The anionic detergent salts which are useful in the present invention are selected from the following classes of anionic detergents:

(1) Alkyl benzene sulfonates in which the alkyl group contains from 9 to 15 carbon atoms, preferably 11 to 14 carbon atoms in straight chain or branched chain configuration. An especially preferred linear alkyl benzene sulfonate contains 12 carbon atoms. U.S. Pat. Nos. 2,220,099 and 2,477,383 describe these detergents.

(2) Alkyl sulfates obtained by sulfating an alcohol having 8 to 22 carbon atoms, preferably 12 to 16 carbon atoms. The alkyl sulfates have the formula $(ROSO_3)_2M$ where R is the $C_{8-22}$ alkyl group and M is the alkaline earth metal.

(3) Paraffin sulfonates having 8 to 22 carbon atoms, preferably 12 to 16 carbon atoms in the alkyl moiety;

(4) Olefin sulfonates having 8 to 22 carbon atoms, preferably 12 to 16 carbon atoms. U.S. Pat. No. 3,332,880 contains a description of suitable olefin sulfonates.

(5) Alkyl ether sulfates derived from ethoxylating an alcohol having 8 to 22 carbon atoms, preferably 12 to 16 carbon atoms with 1 to 30, preferably 1 to 12 moles of ethylene oxide and then sulfating. The alkyl ether sulfates having the formula $$[RO(C_2H_4O)_XSO_3]_2M$$

where R is the $C_{8-22}$ alkyl group, X is 1–30, and M is an alkaline earth metal.

(6) Alkyl glyceryl ether sulfonates having 8 to 22 carbon atoms, preferably 12 to 16 carbon atoms in the alkyl moiety; and (7) Mixtures thereof.

(2) and/or (5) are preferred.

The above-described anionic detergents are all available commercially. The acid form of the anionic detergent can be converted to the alkaline earth metal salt form either prior to admixture with the semi-polar nonionic detergent or thereafter. This conversion can be accomplished either by direct neutralization with an alkaline earth metal base or by ion exchange between, e.g., an alkali metal, ammonium or alkanolammonium salt of the anionic detergent and a non-toxic, water-soluble alkaline earth metal salt. Preferably, a source of magnesium or calcium ions is added to the detergent mixture under desirable reaction conditions to form the desired salts. Calcium and magnesium chlorides, calcium and magnesium sulfates, calcium and magnesium acetates or calcium and magnesium hydroxides and oxides are examples of magnesium and calcium sources. Magnesium chloride and magnesium sulfate are preferred. Magnesium oxide or hydroxide is most preferred.

The cation of the anionic detergent is important in that the alkaline earth metal salts of the herein described anionic detergent perform better in terms of suds persistance, especially in the presence of grease, than the alkali metal, ammonium or alkanolammonium salts of said anionic detergents when in combination with the semi-polar nonionic detergent and the betaine detergent. In some cases, a mixture of cations may be desirable for optimum physical properties or sudsing across a range of conditions and soils, provided sufficient amounts of the anionic surfactant are in the alkaline earth metal form to provide the desired grease removal. Up to about 25% of the above anionic detergents can be in the form of their sodium, potassium, ammonium, mono-, di- or triethanolammonium salts, especially ammonium, monoethanolammonium, or triethanolammonium.

The amidoalkylbetaine surfactant is essential to the improved performance. The suds persistence (mileage) is less when the amidoalkylbetaine is combined with alkali metal anionic and semi-polar nonionic detergent mixtures. Overall superior performance requires all three essential ingredients.

Examples of suitable betaines include coconutacylamidopropyldimethylbetaine; $C_{12-14}$ acylamidopropylbetaine; $C_8$ acylamidohexyldiethylbetaine; 4-[$C_{14-16}$ acylmethylamidodiethylammonio]-1-carboxybutane; $C_{16-18}$ acylamidodimethylbetaine; $C_{12-14}$ acylamidopentanediethylbetaine; 2-[$C_{12-16}$ acylmethylamidodiemethyl]-1-carboxy propane; and $C_{12-16}$ acylmethylamidodimethylbetaine. Preferred betaines are the $C_{10-18}$ acylamidopropane (or ethane) dimethyl (or diethyl) betaines.

Suitable amidoalkylbetaines are disclosed in U.S. Pat. Nos. 3,950,417; 4,137,191; and 4,375,421 and British Patent GB No. 2,103,236, all of which are incorporated herein by reference.

The level of betaine in the product is preferably more than about 1%, desirably about 4 to 6%, where maximum grease handling is desired.

It will be recognized that the alkyl (and acyl) groups for the above detergents can be derived from either natural or synthetic sources e.g., they can be derived from naturally occurring fatty acids; olefins such as those prepared by Ziegler, or Oxo processes; or from olefins separated from petroleum either with or without "cracking". Specific examples, e.g., of alkyl sulfates and alkyl ether sulfates include those derived from Neodol 23 which is a synthetic alcohol prepared by an Oxo process and containing about 42 weight percent of dodecanol and about 54 weight percent of tridecanol.

Ratios of semi-polar nonionic detergent and betaine to anionic detergent (salt basis) of from about 1:20 to about 1:2, preferably from about 1:15 to about 1:3 provide very satisfactory grease removal. The degree of grease removal obtained from the detergent mixture is greater than that achieved by the individual detergents alone when used under normal conditions.

The detergent compositions of this invention are formulated in powder, granular, tablet, paste, or, preferably, liquid form. Regardless of the form of the composition, it is especially effective in the removal of greasy soils.

A preferred detergent composition containing the above-described detergents is in a liquid form. Such liquid compositions are especially useful for the hand washing of soiled cooking utensils and tableware. The liquid compositions contain from about 5% to about 60%, preferably from about 10% to about 50% for concentrated products designed for dilution prior to use and preferably from about 1% to about 40% for products designed for use "as is", of the semi-polar nonionic, anionic, and betaine detergent mixture. The balance of the formula comprises water. All manner of known additives can be included in the liquid composition. For example, suds boosters, organic solvents, e.g., $C_1$–$C_5$ alkanols (preferably ethanol), perfumes, dyes, and hydrotropes can be added for their known functions.

An especially preferred liquid detergent composition also contains a source of alkalinity for increased greasy soil removal. Sodium hydroxide, potassium hydroxide, ammonium hydroxide, and mono-, di- or trialkanolamines wherein said alkanol moieties contain from one to five, preferably two to three carbon atoms, in either a linear or branched configuration are suitable bases. Normally, the higher chain length branched alkanolamines are mono- or di-substituted. Common alkanolamines are mono- and diisopropanolamines and mono-, di- and triethanolamines. Sufficient base is added to the composition to raise its pH to above 7.0, but below about 9.0. Such a composition has not only increased greasy soil removal ability, but also the removal is accelerated. Ammonia, di- and triethanolamines and mixtures thereof are preferred sources of alkalinity because of the resultant compositions' physical characteristics, i.e., the compositions have good fluidity and viscosity.

A liquid detergent composition having the following formulation is most preferred:

(a) from about 2% to about 6% of a water-soluble amine oxide having one alkyl moiety of from about 8 to about 16 carbon atoms and two alkyl moieties of from 1 to about 3 carbon atoms;

(b) from about 10% to about 30% of magnesium alkyl sulfate having from about 12 to about 16 carbon atoms;

(c) from 0% to 30% of a calcium or magnesium, preferably magnesium, alkyl ether sulfate derived from an alcohol having from about 12 to about 16 carbon atoms ethoxylated with from about 1 to about 12 moles of ethylene oxide;

(d) from 0% to about 20% of ammonium, mono-, di-, or triethanolammonium alkyl ether sulfate derived from an alcohol having from about 12 to about 16 carbon atoms ethoxylated with from about 1 to about 12 moles of ethylene oxide;

(e) From about 1% to about 8% of a $C_{12-16}$ acylamidopropyldimethylbetaine;

(f) from 0% to 15% mono-, di-, or triethanolammonium, or ammonium, preferably ammonium sulfate, or chloride, hydroxide or mixtures thereof; and (g) the balance comprises water or water and $C_1$–$C_5$ alkanol (preferably ethanol) mixtures.

More concentrated liquids and/or pastes containing from about 45% to about 95% of said mixture of semi-polar nonionic, anionic, and betaine detergents are also desirable.

The granular or tableted compositions of this invention contain from about 5% to about 50%, preferably from about 10% to about 35% of the semi-polar nonionic, anionic, and betaine detergent mixture. The balance of the composition comprises inert filler salts. A suitable inert filler salt is sodium sulfate. Various additives, e.g., suds suppressors, dyes, perfume, soil anti-redeposition agents, and water can also be included in the granular or tableted composition.

The liquid detergent compositions of this invention are preferably prepared by neutralizing the acid forms of the anionic detergent with the aforementioned sources of alkalinity, magnesium hydroxide, magnesium oxide, and/or adding a soluble alkaline earth metal source, preferably magnesium sulfate or magnesium chloride, to give the finished formula.

The examples which follow are illustrative of this invention.

EXAMPLE I

The following detergent compositions are formulated on a weight percent basis.

| | A | B | C | D | E | F |
|---|---|---|---|---|---|---|
| Sodium dodecyl benzene sulfonate | 22.0 | — | — | — | — | — |
| Magnesium dodecyl benzene sulfonate | — | 22.0 | — | — | — | — |
| Sodium coconut sulfate | — | — | 25.0 | — | — | — |
| Magnesium coconut sulfate | — | — | — | 25.0 | — | — |
| Sodium $C_{14}$ olefin sulfonate | — | — | — | — | 25.0 | — |
| Magnesium $C_{14}$ olefin sulfonate | — | — | — | — | — | 25.0 |
| Dimethyldodecylamine oxide | 4.0 | 4.0 | 4.0 | 4.0 | 4.0 | 4.0 |
| $C_{12-14}$ acylamidopropyl-dimethyl betaine | — | 5.0 | — | 5.0 | — | 5.0 |
| Triethanolamine | 3.5 | 3.5 | 3.5 | 3.5 | 3.5 | 3.5 |
| Water | 63.0 | 63.0 | 60.0 | 60.0 | 60.0 | 60.0 |
| Ethanol | 5.0 | 5.0 | 5.0 | 5.0 | 5.0 | 5.0 |
| Misc. (perfume, dye, et.) | | | balance | | | |

| | G | H | I | J | K | L |
|---|---|---|---|---|---|---|
| Sodium $C_{14}$ paraffin sulfonate | 26.0 | — | — | — | — | |
| Magnesium $C_{14}$ paraffin sulfonate | — | 26.0 | — | — | — | — |
| Sodium salt of a sulfated coconut alcohol ethoxylated with 3 moles of ethoxylated oxide | — | — | 34.0 | — | — | — |
| Magnesium salt of a sulfated coconut alcohol ethoxylated with 3 moles of ethylene oxide | — | — | — | 34.0 | — | — |
| Sodium coconut glyceryl ether sulfonate | — | — | — | — | 30.0 | — |
| Magnesium coconut glyceryl ether sulfonate | — | — | — | — | — | 30.0 |
| Dimethyldodecylamine oxide | 4.0 | 4.0 | 4.0 | 4.0 | 4.0 | 4.0 |
| $C_{12-14}$ acylamidopropyl-dimethyl betaine | — | 5.0 | — | 5.0 | — | 5.0 |
| Triethanolamine | 3.5 | 3.5 | 3.5 | 3.5 | 3.5 | 3.5 |
| Water | 59.0 | 59.0 | 51.0 | 51.0 | 55.0 | 55.0 |
| Ethanol | 5.0 | 5.0 | 5.0 | 5.0 | 5.0 | 5.0 |
| Misc. (perfume, dye. et.) | | | balance | | | |

When compositions A–L are tested for their ability to remove grease from a soiled surface, the results will show that the compositions of this invention, i.e. compositions B, D, F, H, J and L will remove more grease and have better suds mileage than the similar compositions wherein the magnesium cation and betaine are not employed.

EXAMPLE II

| | % |
|---|---|
| MG $C_{12-13}$ alkyl sulfate | 5.0 |
| Mg $C_{12-13}$ alkyl polyethoxylate (1.0) sulfate | 15.1 |
| $NH_4$ $C_{12-13}$ alkyl polyethoxylate (1.0) sulfate | 8.1 |
| $C_{12-13}$ alkyldimethylamine oxide | 2.7 |
| $NH_4$ xylene sulfonate | 3.0 |
| Ethanol | 5.0 |
| Water and minor ingredients | balance |

This base formula was compared to compositions A, B and C in which 5% $C_{12-14}$ acylamidopropyl betaine was added. In addition, in A the Mg salts were replaced by ammonium salts and in B the amine oxide was removed. Water was removed or added to maintain the given percentages.

A preweighed 250 cc. polypropylene cup has 3 cc. of a melted beef grease applied to its inner bottom surface. After the grease has solidified, the cup is reweighed. Then a 0.4% aqueous solution of the composition to be tested is added to the cup to completely fill it. The aqueous solution has a temperature of 45° C. After 15 minutes, the cup is emptied and rinsed with distilled water. The cup is dried and then weighed to determine the amount of grease removal. The results of tests performed on the above compositions are reported as follows on a % grease removal basis.

| Formula | % Grease Removal |
|---|---|
| Base | 67 |
| Composition A | 72 |
| Composition B | 56 |
| Composition C | 71.5 |

As can be seen from the above, the amine oxide and the magnesium anionic detergent and/or betaine are essential for optimum grease removal. In soft water, both the magnesium anionic detergent and the betaine are required for both improved suds mileage and improved grease removal.

What is claimed is:

1. A detergent composition especially effective in removing greasy soils wherein the organic detergent portion of said composition consists essentially of a mixture of:

(a) from about ½% to about 6% of a semi-polar organic nonionic detergent comprising water-soluble amine oxides having one alkyl or hydroxy alkyl moiety of 8 to 28 carbon atoms and two alkyl moieties selected from the group consisting of alkyl groups and hydroxy alkyl groups of 1 to 3 carbon atoms;

(b) from about 10% to about 50% of an alkaline earth metal salt of an anionic detergent selected from the group consisting of (1) linear alkyl benzene sulfonates having 9 to 15 carbon atoms in the alkyl group, (2) alkyl sulfates having 8 to 22 carbon atoms, (3) alkyl ether sulfates having 8 to 22 carbon atoms in the alkyl group and 1 to 30 ethylene oxide units, and (4) mixtures thereof;

(c) from about ½% to about 6% of an acylamidoalkylbetaine of the formula:

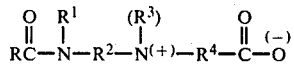

wherein R is an alkyl group containing from about 7 to about 21 carbon atoms, $R^1$ is hydrogen or an alkyl group containing from 1 to about 6 carbon atoms, $R^2$ is an alkylene group containing from 1 to about 10 carbon atoms, each $R^3$ is an alkyl or hydroxy group containing from 1 to about 6 carbon atoms or an ethoxylated hydroxy group containing from about 1 to about 10 ethylene oxide units, and $R^4$ is an alkylene group containing from 1 to about 6 carbon atoms.

2. The detergent composition of claim 1 wherein the semi-polar organic nonionic detergent is a water-soluble amine oxide and said alkaline earth metal salt is a magnesium salt.

3. The detergent composition of claim 2 wherein the anionic detergent is selected from the group consisting of: an alkyl sulfate having 8 to 22 carbon atoms; an alkyl ether sulfate derived from an alcohol having 8 to 22 carbon atoms ethoxylated with 1 to 15 moles of ethylene oxide; and mixtures thereof.

4. The detergent composition of claim 2 wherein the ratio of amine oxide and betaine detergents to anionic detergent is from about 1:20 to about 1:2.

5. The detergent composition of claim 4 wherein the ratio of amine oxide and betaine detergents to anionic detergent is from about 1:15 to about 1:3.

6. The detergent composition of claim 2 in a liquid form wherein the composition consists essentially of from 1% to about 45% of said mixture, and the balance consists essentially of water or mixtures of water and $C_1$–$C_5$ alkanols.

7. The detergent composition of claim 6 wherein the ratio of amine oxide and betaine detergents to anionic detergent is from about 1:20 to about 1:2.

8. The detergent composition of claim 1 wherein, in the semi-polar nonionic and anionic detergents, the long chain alkyl groups contain from about 8 to about 16 carbon atoms and, in the acylamidoalkylbetaine, R contains from about 9 to about 17 carbon atoms, $R^1$ is hydrogen, $R^2$ contains from about 2 to about 6 carbon atoms, $R^3$ contains from one to about 3 carbon atoms, and $R^4$ contains one carbon atom.

9. The detergent composition of claim 8 wherein $R^2$ contains 3 carbon atoms and $R^3$ contains one carbon atom.

10. The detergent composition of claim 8 wherein the semi-polar organic nonionic detergent is a water-soluble amine oxide and said alkaline earth metal salt is a magnesium salt.

11. The detergent composition of claim 10 wherein the anionic detergent is selected from the group consisting of: an alkyl sulfate having 8 to 22 carbon atoms; an alkyl ether sulfate derived from an alcohol having 8 to 22 carbon atoms ethoxylated with 1 to 15 moles of ethylene oxide; and mixtures thereof.

12. The detergent composition of claim 10 wherein the ratio of amine oxide and betaine detergents to anionic detergent is from about 1:20 to about 1:2.

13. The detergent composition of claim 12 wherein the ratio of amine oxide and betaine detergents to anionic detergent is from about 1:15 to about 1:3.

14. The detergent composition of claim 13 in a liquid form wherein the composition consists essentially of from 1% to 45% of said mixture, and the balance water or mixtures of water and $C_1$–$C_5$ alkanols.

15. The detergent composition of claim 14 wherein the amine oxide is a $C_{12-16}$ dimethylamine oxide.

16. A detergent composition according to claim 1 in the form of a liquid consisting essentially of:

(a) from 2% to 6% of a water-soluble amine oxide having one alkyl moiety of 8 to 16 carbon atoms and two alkyl moieties of 1 to 3 carbon atoms;

(b) from 10% to 30% of a magnesium alkyl sulfate having 12 to 16 carbon atoms;

(c) from 0% to 20% of a detergent selected from the group consisting of sodium, potassium, ammonium, substituted ammonium, magnesium and mixtures thereof; alkyl ether sulfates derived from alcohols having 12 to 16 carbon atoms ethoxylated with 1 to 12 moles of ethylene oxide;

(d) from about 1% to about 6% of $C_{12-16}$ acylamidopropylbetaine; and (e) the balance water or mixtures of water and $C_1$–$C_5$ alkanol.

17. The detergent composition of claim 14 wherein the composition consists essentially of from 10% to 35% of (a)+(b)+(c)+(d) and the ratio of (b)+(c) to (a)+(d) is from about 3:1 to about 15:1.

* * * * *